US007210808B2

(12) United States Patent
Malpetti

(10) Patent No.: US 7,210,808 B2
(45) Date of Patent: May 1, 2007

(54) INTERIOR LIGHTING DEVICE FOR A REFRIGERATION COMPARTMENT, IN PARTICULAR OF A REFRIGERATOR OR FREEZER

(75) Inventor: Roberto Malpetti, Lozza (IT)

(73) Assignee: ITW Industrial Components S.R.L., Milan (IT)

( * ) Notice: Subject to any disclaimer, the term of this patent is extended or adjusted under 35 U.S.C. 154(b) by 29 days.

(21) Appl. No.: 11/151,321

(22) Filed: Jun. 14, 2005

(65) Prior Publication Data

US 2005/0276034 A1 Dec. 15, 2005

(30) Foreign Application Priority Data

Jun. 15, 2004 (IT) ..... TO2004A0398

(51) Int. Cl.
*F21V 33/00* (2006.01)

(52) U.S. Cl. ..... 362/92; 362/800

(58) Field of Classification Search ..... 362/92–94, 362/89, 101, 800

See application file for complete search history.

(56) References Cited

U.S. PATENT DOCUMENTS 6,578,979 B2 * 6/2003 Truttmann-Battig ..... 362/92
6,623,273 B2 * 9/2003 Evangelisti ..... 434/185
6,726,341 B2 * 4/2004 Pashley et al. ..... 362/92
6,804,974 B1 * 10/2004 Voglewede et al. ..... 62/264
2002/0051357 A1 5/2002 Truttmann-Battig
2003/0137828 A1 7/2003 Ter-Hovhannisian
2004/0062031 A1 4/2004 Pinter
2005/0046595 A1 * 3/2005 Blyth ..... 340/908

FOREIGN PATENT DOCUMENTS

DE 202 10 099 U 1 * 9/2002
DE 102 02 444 A1 7/2003

* cited by examiner

*Primary Examiner*—Sandra O'Shea
*Assistant Examiner*—James W Cranson, Jr.
(74) *Attorney, Agent, or Firm*—Lowe Hauptman & Berner, LLP

(57) ABSTRACT

A lighting device having a bulb-holder made of synthetic, electrically-nonconducting material; possibly a transparent cover; a light source; and electronic controlling elements for controlling the light source; the light source includes a high-efficiency, violet-tinged white-light, light-emitting diode (LED), and possibly a reflector formed integral with the bulb-holder; and the bulb-holder defines a lighting fixture fittable to an inner wall of a refrigeration compartment, and having elements, typically a thermostat, for detecting and controlling operating parameters of the refrigeration compartment.

5 Claims, 1 Drawing Sheet

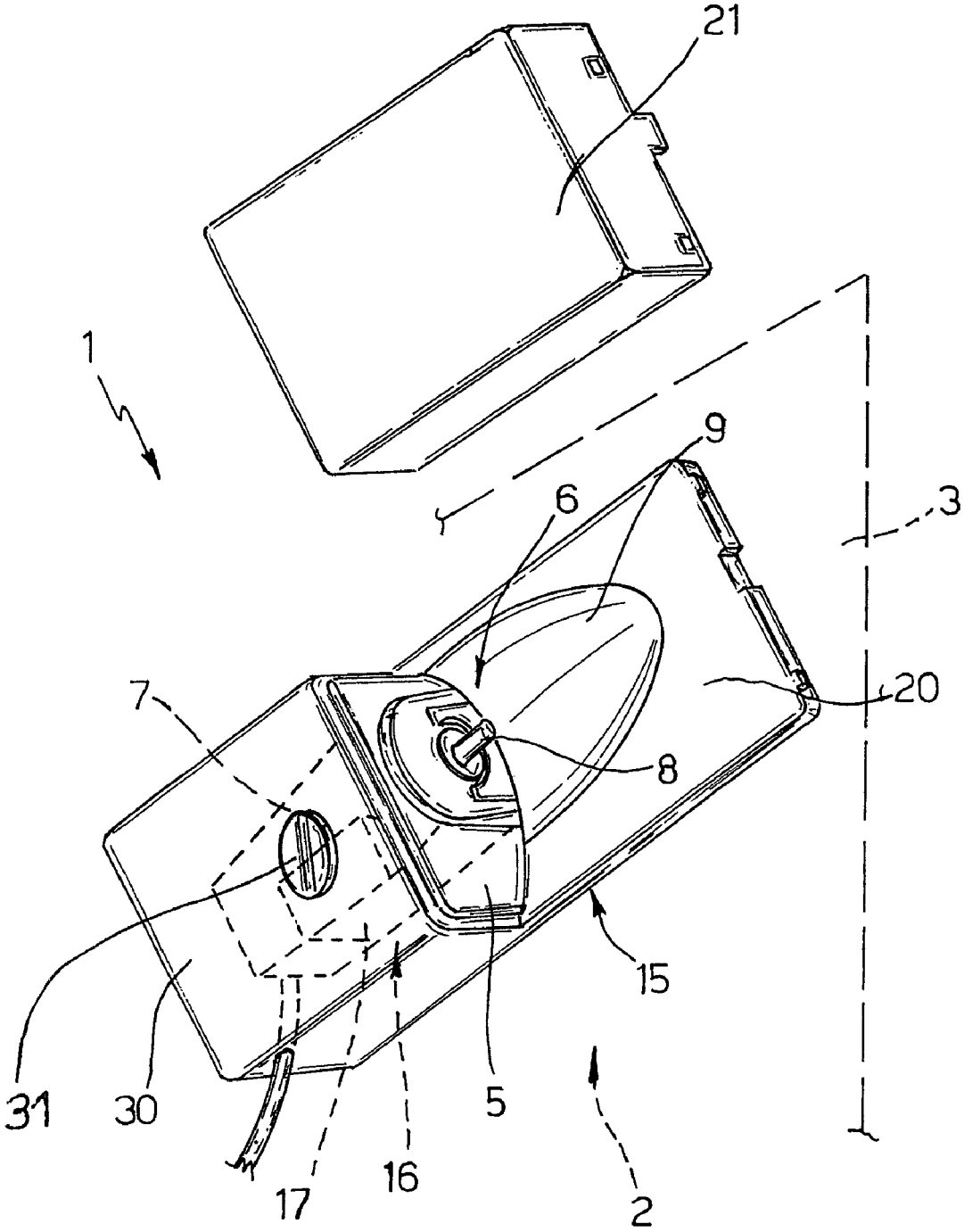
21
1
9
6
3
20
7
8
15
31
30
5
17
16
2

INTERIOR LIGHTING DEVICE FOR A REFRIGERATION COMPARTMENT, IN PARTICULAR OF A REFRIGERATOR OR FREEZER

RELATED APPLICATIONS

The present application is based on, and claims priority from, Italian Application Number TO 2004 A 000398, filed Jun. 15, 2004, the disclosure of which is hereby incorporated by reference herein in its entirety.

The present invention relates to an interior lighting device for a refrigeration compartment, in particular of a refrigerator or freezer.

BACKGROUND OF THE INVENTION

As is known, refrigeration compartments of any type require an internal lighting device, which is deactivated when the refrigeration compartment is closed; and control and detecting means for controlling and detecting operating parameters of the refrigeration compartment—typically temperature and, possibly, humidity—and comprising at least one electromechanical or electronic thermostat.

Such devices are currently mounted together on a common member defined by a lighting fixture fitted to an interior wall of the refrigeration compartment and comprising a bulb-holder made of synthetic, electrically-nonconducting material and fitted with a light source defined by an incandescent bulb; electronic control means for controlling the light source; and at least one, preferably electronic, thermostat. The bulb-holder also has a transparent cover to protect the bulb.

Known lighting fixtures of the type described above have numerous drawbacks, mostly due to the light source being defined by an incandescent bulb and so constituting an electric element operating at fairly high voltage (typically 220 V mains voltage) and generating a fairly large amount of heat and relatively high operating temperatures.

This therefore calls for precise control of electrical power supply to the incandescent bulb by means of an electronic circuit comprising fairly high-cost components, such as a TRIAC, and a positive-temperature coefficient element (PTC pill) for ensuring the light source is turned off after a given length of time (e.g. in the event the refrigeration compartment door is not closed properly, thus failing to activate the off switch, or in the event of malfunction of the off switch).

Moreover, featuring a mains-voltage-powered element, the lighting fixture must be made according to rigid regulations governing the minimum distance between the high-voltage and low-voltage, typically electronic, components, thus complicating manufacture and increasing bulk.

Moreover, because most refrigeration compartments are cooled by expansion of a refrigeration fluid, which, in most cases, is potentially explosive, known lighting devices must be specially designed to prevent any situation, including accidental breakage of the light source, from generating sparks or at any rate discharging voltage.

Finally, incandescent bulbs have fairly poor lighting characteristics, e.g. they emit a white light with a strong yellowish component, and have a fairly short working life, thus requiring frequent replacement and so posing serious manufacturing problems.

On the other hand, replacing incandescent bulbs with other light sources, such as light-emitting diodes, has always been ruled out by technicians, mainly on the grounds of the high cost (and insufficient lighting power) of such diodes. That is, forming part of electric household appliances such as refrigerators and/or freezers, which have a very small profit margin, the lighting fixtures of refrigeration compartments must necessarily be fairly cheap to produce.

SUMMARY OF THE INVENTION

It is an object of the present invention to eliminate the drawbacks of known lighting devices by providing a lighting device capable of emitting a white light of pleasing colour, and which is cheap to produce, compact, and reliable, produces no sparks or voltage discharge, even in the event of accidental breakage, and can be combined easily, in use, with other devices, typically a preferably electronic thermostat.

According to the present invention, there is provided an internal lighting device for a refrigeration compartment, in particular of a refrigerator or freezer, as claimed in the attached claims.

More specifically, the lighting device according to the invention comprises a bulb-holder made of synthetic, electrically-nonconducting material; a light source; and electronic control means for controlling the light source, wherein the light source is defined by a high-efficiency, white-light, light-emitting diode (LED) and possibly by a reflector, both formed integrally and preferably in one piece with the bulb-holder.

The bulb-holder defines a lighting fixture, which can be fitted in use to an interior wall of the refrigeration compartment; the lighting fixture comprises, in combination, detecting and control means, typically a preferably electronic thermostat, for detecting and controlling operating parameters of the refrigeration compartment; the bulb-holder comprises a transparent cover made of thermoplastic material with a relatively low softening temperature; whereas the light-emitting diode is selected of relatively high power, in particular of over 10,000 (e.g. 15,000) millicandles.

In-depth research by the Applicant's technicians, in fact, has surprisingly revealed that using a light-emitting diode as a light source greatly simplifies the light source electronic control circuit, e.g. by eliminating use of TRIACs and PTC components, thus enabling more than sufficient saving in the manufacturing cost of the lighting device to offset the greater cost of the light-emitting diode as compared with an incandescent bulb.

On the one hand, therefore, using a particular type of light-emitting diode (having high-efficiency and white-light), the refrigeration compartment is illuminated with violet-tinged white light, with absolutely no yellow, to produce an entirely new, attractive lighting effect, which has also proved less tiring on the eye of the user. At the same time, lighting power is increased, a characteristic which is further enhanced by the possibility of using a higher-power light source, because of the LED, unlike an incandescent bulb, having substantially no heating effect, as will be seen.

On the other hand, being a low-voltage component, a light-emitting diode combines well with other electronic components, such as a thermostat, so that, by appropriately shaping the bulb-holder, an integrated lighting fixture can be achieved for both lighting and temperature control, and which is far more compact than known fixtures. The absence of a high-voltage component, such as an incandescent bulb, in fact, eliminates conformance with regulations governing the minimum distance between the lighting and other on board components of the fixture, thus reducing overall size.

Moreover, since a LED produces substantially no heat, the synthetic components of the device, including the transparent protective cover, can be made of cheaper materials, such as low-melt thermoplastic resins, thus further reducing production cost, so that, ultimately, the overall cost of the lighting device according to the invention is far less than a similar conventional component, i.e. a lighting device featuring an incandescent bulb.

Finally, the light-emitting diode used as a light source according to the invention has the further advantage of involving no discharge, sparks or voltage accumulation, even if damaged, and of having a long working life, thus eliminating the need for periodic replacement during the working life of the lighting device. As such, manufacturing cost can be further reduced by forming the LED integrally in one piece with the bulb-holder (e.g. by co-molding or other methods), and by eliminating the explosion safety features currently required using incandescent bulbs.

BRIEF DESCRIPTION OF THE DRAWING

Further characteristics and advantages of the present invention will be clear from the following description of a non-limiting embodiment of the present invention made with reference to the accompanying drawings, which shows a schematic, three-quarter front view in perspective of a lighting device in accordance with the invention.

DETAILED DESCRIPTION OF THE INVENTION

Number 1 in the accompanying drawing indicates as a whole an interior lighting device for a refrigeration compartment 2 (shown only partly and indicated schematically by a dash line). Refrigeration compartment 2 forms part of any known type of refrigerator or freezer, and is bounded by inner lateral walls 3, of which only one is shown for the sake of simplicity.

Device 1 comprises a bulb-holder 5 made of synthetic, electrically-nonconducting material (e.g. any synthetic plastic material); a light source 6; and electronic means 7 for controlling light source 6, which, according to the main characteristic of the invention, is defined by a high-efficiency, white-light light-emitting diode (LED) 8, and possibly by a reflector 9 formed, like LED 8, integral with bulb-holder 5.

Bulb-holder 5 is shaped to define a lighting fixture 15 fittable, in use, in known manner to inner wall 3 of refrigeration compartment 2, and comprising means 16 for detecting and controlling operating parameters of the refrigeration compartment, and in turn comprising, in the example shown, a preferably electronic thermostat 17 indicated by a dash line and housed inside the bulb-holder, together with an electronic circuit featuring electronic means 7 controlling LED 8.

Reflector 9, like LED 8, is formed in one piece with bulb-holder 5. More specifically, reflector 9 is formed on a supporting member 20, for supporting a transparent cover 21 protecting light source 6, and on the opposite side to cover 21. Light-emitting diode 8 projects towards member 20, so as to be located at the focus of reflector 9, which, for example, is substantially parabolic in shape.

Transparent cover 21 is made of thermoplastic material having a relatively low softening point, even though it is located, in use, extremely close to light source 6. In fact, the heat emitted, in use, by diode 8 is negligible and such as to produce no noticeable increase in the temperature of cover 21, even if left on for a prolonged period of time.

Because of this characteristic, intrinsic of LEDs, light-emitting diode 8 is selected of relatively high power—in particular, of over 10,000, e.g. 15,000 millicandles—to produce a highly efficient, attractive violet-white lighting effect. Moreover, the conventional PTC element, for turning off light source 6 if left on for prolonged periods, may be eliminated from electronic control circuit 7. In other words, LED 8 may be left on permanently with no noticeable overheating.

A front face 30 of bulb-holder 5 is fitted with a known control knob 31 for controlling thermostat 17, which is located immediately adjacent to LED 8 and control means featured by electronic circuit 7.

In the event of a malfunction of LED 8, which is formed in one piece with bulb-holder 5, the whole lighting fixture 15 must be replaced. This is extremely unlikely, however, and could only be caused by a faulty LED, which is covered by guarantee. As such, lighting fixture 15 is easy and cheap to produce, despite the relatively high cost of LED 8.

The invention claimed is:

1. An interior lighting device for a refrigeration compartment, in particular of a refrigerator or freezer, comprising:

a bulb-holder made of synthetic, electrically-nonconducting material;

a light source; and an electronic controlling element for controlling the light source, wherein the light source is defined by a high-efficiency, white-light, light-emitting diode (LED); and a reflector formed integral with the bulb-holder wherein said bulb-holder defines a lighting fixture fittable, in use, to an inner wall of the refrigeration compartment; and at least one detecting and controlling element configured to detect and control operating parameters within the refrigeration compartment;

wherein the at least one detecting and controlling element comprises a thermostat.

2. A lighting device as claimed in claim 1, wherein said bulb-holder comprises a transparent cover.

3. A lighting device as claimed in claim 2, wherein said reflector is formed in one piece with said bulb-holder on a supporting member of said transparent cover, and on the opposite side to the transparent cover, and said light-emitting diode projects towards the transparent cover.

4. A lighting device as claimed in claim 2, wherein said transparent cover is made of thermoplastic material having a relatively low softening point.

5. A lighting device as claimed in claim 1, wherein said light-emitting diode is selected of relatively high power, in particular of over 10,000 millicandles.

* * * * *